US005281952A

United States Patent [19]

Dragan

[11] Patent Number: 5,281,952

[45] Date of Patent: Jan. 25, 1994

[54] LIGHT—RESPONSIVE ENCLOSURE ALARM

[76] Inventor: Stephen Dragan, 826 rue Carignan, LaSalle, Quebec, Canada, H8R 4B3

[21] Appl. No.: 901,101

[22] Filed: Jun. 19, 1992

[51] Int. Cl.[5] ..... G08B 13/18

[52] U.S. Cl. ..... 340/546; 340/555; 340/600; 340/691

[58] Field of Search ..... 340/546, 555, 600, 691

[56] References Cited

U.S. PATENT DOCUMENTS

| | | | |
|---|---|---|---|
| 3,300,770 | 1/1967 | Brousseau et al. | 340/568 |
| 3,909,819 | 9/1975 | Radford | 340/569 |
| 3,930,249 | 12/1975 | Steck et al. | 340/568 |
| 4,030,087 | 6/1977 | Ritchie et al. | 340/566 |
| 4,063,251 | 12/1977 | Harsnett | 340/545 |
| 4,155,077 | 5/1979 | Rohan et al. | 340/546 |
| 4,242,670 | 12/1980 | Smith | 340/568 |
| 4,255,745 | 3/1981 | Rohan et al. | 340/546 |
| 4,422,068 | 12/1983 | Helft et al. | 340/541 |
| 4,558,307 | 12/1985 | van Lidt de Jeude | 340/527 |
| 4,617,556 | 10/1986 | Rivera et al. | 340/546 |
| 4,797,663 | 1/1989 | Rios | 340/691 |
| 4,977,392 | 12/1990 | Loda | 340/568 |
| 5,087,908 | 2/1992 | Sanders, Jr. | 340/691 |

*Primary Examiner*—Glen R. Swann, III

*Attorney, Agent, or Firm*—Hoffman, Wasson & Gitler

[57] ABSTRACT

A device for determining whether a darkened enclosure has been opened by an unauthorized user. Though it responds to the presence of light, the device may be actuated either in light or in darkness without compromising its performance. When placed into a darkened enclosure, the device has the capacity of informing the authorized user of a possible unauthorized opening. After an unauthorized opening, an audible alarm would be triggered for a predetermined period of time. Subsequent to the cessation of this audible alarm, the authorized user by viewing the status of a light emitting diode after depressing an on/off switch, can determine whether an unauthorized user has gained access to the enclosure.

2 Claims, 2 Drawing Sheets

LIGHT—RESPONSIVE ENCLOSURE ALARM

BACKGROUND OF THE INVENTION

The present invention is directed to a personal alarm which is used to protect valuables or other items provided in an unlit or darkened enclosure of a relatively small area.

The prior art is replete with various devices used to protect valuables provided in an unlit or darkened enclosure having a relatively small area. Typical of these prior art devices are those which are described in U.S. Pat Nos. 3,909,819 issued to Radford; 3,930,249 issued to Steck et al; 4,063,251 issued to Harsnett; 4,155,077 issued to Rohan et al; 4,242,670 issued to Smith; 4,255,745 to Rohan et al; 4,558,307 issued to van Lidt de Jeude; 4,617,556 issued to Rivera et al; and 4,977,392 issued to Loda.

Generally, these prior art devices are used to protect items stored in lockers provided at work or at athletic clubs, automobile glove compartments, an office drawer, a briefcase, various household or medicine cabinets provided in the home or office, or similar environments.

For example, the patents to Rohan et al describe an apparatus for audibly signalling the opening of a darkened enclosure. The apparatus described in these patents would include a battery powered system comprising a photodetector, a time delay, an oscillator, an amplifier, and a transducer, such as a small loudspeaker. The opening of the darkened enclosure is sensed by the photodetector allowing the time delay circuit to be initiated. The patent to Rivera et al illustrates a photosensitive sound generator which is adapted to be placed in a darkened enclosure. Once the enclosure is opened, a sound transducer, such as a piezoelectric device, will become audible. Additionally, the patent to Smith shows a photosensitive alarm system which produces a signal upon exposure to ambient light for protection of cash drawers, file cabinets and similar darkened enclosures. This system is capable of detecting multiple intrusions, recording the number of intrusions, and providing alarm signals indicative of the number of intrusions.

Other prior art devices operate by requiring the intruder to physically contact the alarm, thereby completing a ground path that latches an electronic on/off switch. Another prior art device protects a glove compartment from intrusion by detecting a change of air pressure produced by suddenly opening the compartment door. Yet another prior art device is designed to protect a child from the contents of a medicine cabinet or household cleanser cupboard requiring two units as well as a magnetic switch to operate properly.

However, the prior art does not anticipate or suggest a device which is used to protect items included in a darkened enclosure, whereby an audible signal is produced for a predetermined period of time when the darkened enclosure is opened and the device is not disabled after a predetermined time delay and which would give the authorized user of the alarm a virtually instantaneous indication that the darkened enclosure was opened, even after the audible alarm ceases to produce a signal.

SUMMARY OF THE INVENTION

These and other deficiencies of the prior art are addressed by the present invention which provides a photosensitive alarm placed in various darkened enclosures, such as a locker, a cabinet, a vehicular glove compartment, a briefcase and the like. A switch is provided to turn on the device in either light or darkness. If the alarm is turned on in light, it would enter the READY state from a DORMANT state which could illuminate a light emitting diode. When turned on in darkness, or placed in a darkened environment while in the READY state, the alarm would enter the STAND-BY state and the light emitting diode would be unlit. When the enclosure is subsequently opened, light is sensed by a photosensitive device and the alarm would enter a PRE-ALARM state, giving the authorized user of the alarm time to turn off the device. If the alarm is not turned off during the PRE-ALARM state, the alarm will enter the ALARMED state, at which time an audible alarm would be produced for a predetermined period of time, such as 40 to 45 seconds and the light emitting diode remains unlit. Upon completing this period of time, the alarm would place itself back into the DORMANT state with the light emitting diode still unlit. When the authorized individual returns to the enclosure, and attempts to turn the unit off, thereby returning back into the DORMANT state, the unit will be placed into the READY state since it is currently in the DORMANT state. The authorized user would be alerted to the alarm being in the READY state since the light emitting diode would become illuminated. It is noted that this light emitting diode will not be illuminated when the alarm is in the DORMANT state.

These and other objects and advantages of the present invention will be illustrated in a more detailed description of the invention.

DETAILED DESCRIPTION OF THE INVENTION

Figure 1:
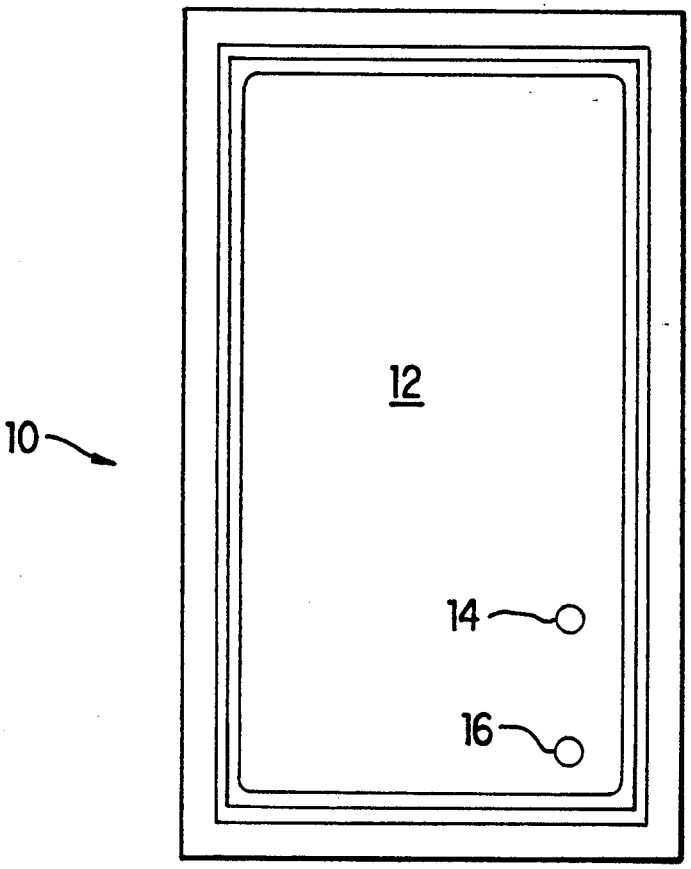
FIG. 1 is a top view of the alarm of the present invention.
Figure 2:
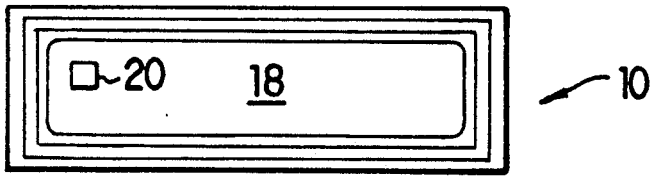
FIG. 2 is a side view of the alarm of the present invention.

The universal personal alarm 10 of the present invention is illustrated in FIGS. 1 and 2. The alarm 10 is designed to be housed in a relatively small, compact plastic casing approximately 4.5" long, 2.75" wide by 1" high. On one of the planar surfaces 12, a photosensitive device 14 is provided as well as a light emitting diode 16. A miniature toggle-type pushbutton switch 20 is provided on a second planar surface 18. However, it is noted that the exact placement of the pushbutton 20, as well as the photosensor 14 and the light emitting diode 16, are not crucial to the present invention, and that all of these devices can be on a single surface.

Figure 3:
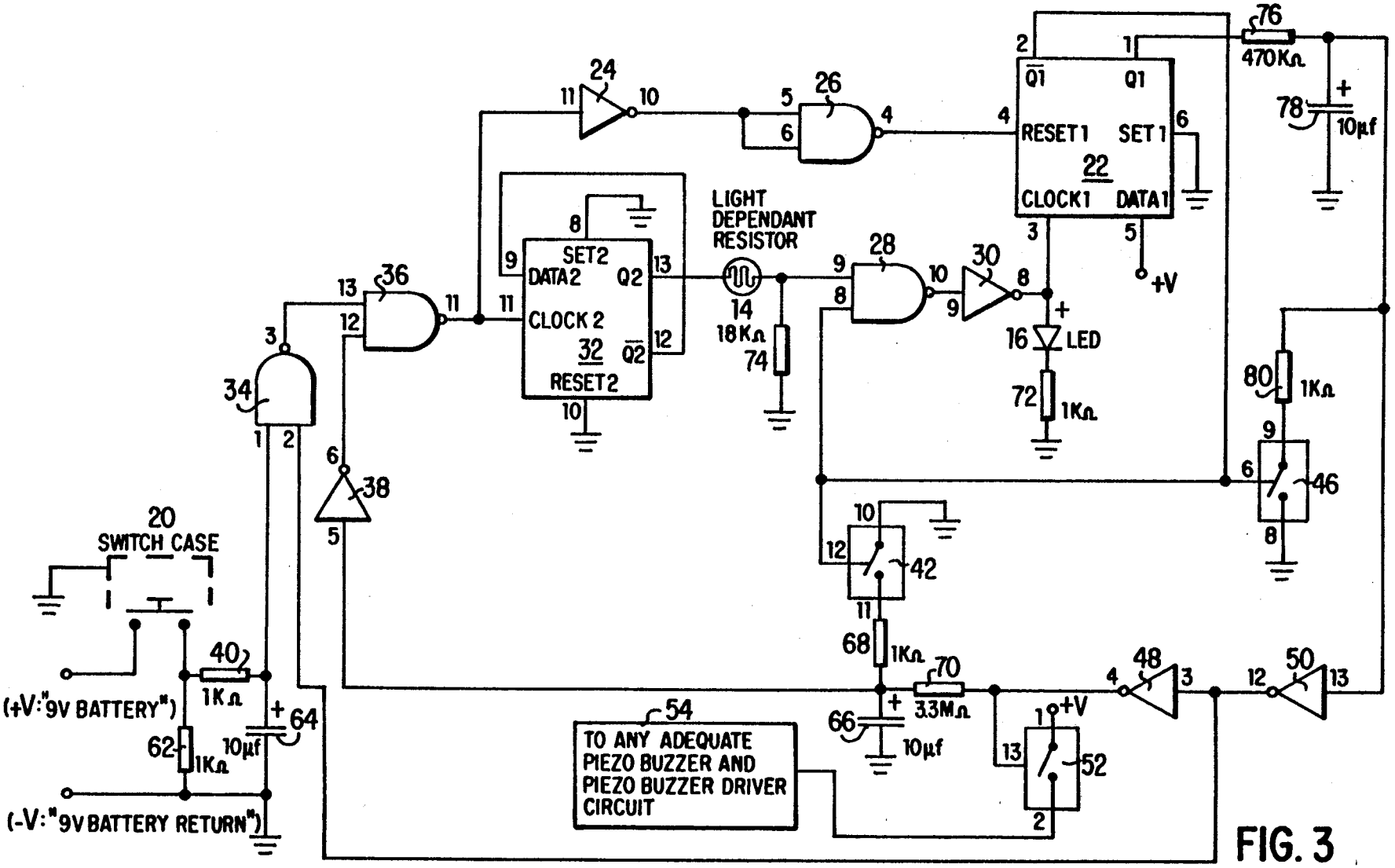
FIG. 3 is a block circuit diagram of the circuitry of the present invention.

FIG. 3 illustrates a block circuit diagram of the present invention. A single switch 20 is used to both enable and disable the unit. A standard 9 volt battery is connected to this switch and to a debounce circuit including a resistor 40, a resistor 62 and a capacitor 64 to provide for foolproof on/off operation. Prior to the unit being enabled, the alarm is in the DORMANT state. When the alarm is turned on in light, the light emitting diode 16 would immediately become illuminated to indicate that the alarm is in the READY mode. If the switch 20 is turned on in darkness, the alarm would directly enter the STAND-BY mode and the light emitting diode 16 would remain unlit. The particular manner in which the alarm unit enters the STAND-BY mode after being turned on in light or darkness is accomplished by the present circuitry which connects the switch 20 to a D Flip Flop 22 utilizing two distinct pathways. When turned on in darkness, the switch 20 is connected through NAND Schmitt Trigger 34 through NAND Schmitt Trigger 36 through a HEX inverting Schmitt Trigger 24 and NAND Schmitt Trigger 26. A HEX inverting Schmitt Trigger 38 is used as the second input to the NAND Schmitt Trigger 36. In this instance, the light emitting diode 16 is not illuminated and the unit directly enters the STAND-BY mode. When the switch 20 is depressed in light, the connection between the switch 20 and D Flip Flop 22 is provided through a D Flip Flop 32 and a photosensitive device 14, which can be a light dependent resistor, connected to a resistor 74. The output of the light dependent resistor 14 is sent to one of two inputs of a NAND Schmitt Trigger 28, the output of which serves as the input to a HEX inverting Schmitt Trigger 30, which in turn is connected between the clock input of the D Flip Flop 22 and light emitting diode 16 and resistor 72. In this instance, the alarm is in the READY mode and the light emitting diode 16 would remain illuminated until the alarm is placed into the darkened enclosure resulting in the alarm moving to the STAND-BY state.

Once the alarm unit is turned on and placed into the darkened enclosure, either one of two scenarios would occur. According to both scenarios, once the darkened enclosure is opened and the photosensitive device 14 senses light radiation, the alarm system would be transferred from the STAND-BY state to the PRE-ALARM state. During one scenario, when the unit is in the PRE-ALARM state, the authorized user has the opportunity to turn off the device by depressing the switch 20 to place it back into the DORMANT state during a time period of approximately three to four seconds. Resistor 76 and capacitor 78 are used as a timing means for sensing whether the switch 20 has been depressed in the allotted time. During this time, the capacitor 78 is charging. If the switch 20 has been depressed in the allotted time, resistor 80 and quad bilateral switch 46 would short the capacitor 78 as well as causing output Q2 of D Flip Flop 32 to go low via the debounce circuit including resistor 40, resistor 62, and capacitor 64, and the NAND Schmitt Trigger 34 and the NAND Schmitt Trigger 36, thereby placing the alarm unit in the DORMANT state. If this occurs, the audible alarm such as a piezo buzzer connected to a suitable piezo buzzer driver circuit 54 will not be triggered. In this instance, the light emitting diode will not become illuminated when the unit moves from the PRE-ALARM state to the DORMANT state. It is also noted that the light emitting diode is not illuminated when the unit is in the PRE-ALARM state.

If, however, an intruder opens the darkened enclosure, the intruder would not be aware of the presence of the alarm unit and the alarm will proceed from the STAND-BY state to the PRE-ALARM state to the ALARM state. When the unit is in the ALARM state, the switch 46 will be open and a signal will be sent through HEX inverting Schmitt trigger 50, to HEX inverting Schmitt trigger 48, the combination of resistors 68, 70 and capacitor 66 will trigger the alarm 54 for a predetermined period of time, such as 40 to 45 seconds, during which time the capacitor 66 is charging. After this period of time, the unit will move from the ALARM state back to the DORMANT state. Quad bilateral switch 52 will be closed while the time the capacitor 66 is charging, thereby allowing the alarm 54 connected thereto to sound. Switch 42 will close after the completion of the alarm cycle, thereby discharging the capacitor 66.

After this has occurred, and the authorized user returns and opens the darkened enclosure, this user will attempt to turn off the unit from what is presumed to be the PRE-ALARM state to the DORMANT state. Since the unit is now in the DORMANT state after the unauthorized access to the darkened enclosure, the light emitting diode will become illuminated since it is actually moving from the DORMANT state to the READY state in light, thereby alerting the authorized user that an unauthorized unit has gained access to the darkened enclosure. However, if the unit was not tampered with, then it would indeed enter the DORMANT state and the light emitting diode would not illuminate.

Both the DELAY-ON and TIME-OUT circuits have their capacitors grounded during NON-DELAY and NON-TIME-OUT states insuring that the DELAY-ON and TIME-OUT times would always have their own particular values.

The specific embodiments shown and described herein are intended to be illustrative and not restrictive of the scope of the invention, it being understood that the claims are intended to encompass all variations within the range of equivalence.

What is claimed is:

1. A portable alarm used to protect the contents of a normally darkened enclosure comprising:

a battery for powering the alarm;

an on/off switch;

an audio signal device;

a first flip flop circuit connected between said on/off switch and said audio signal device, said alarm being initially in a DORMANT state;

a photosensor;

a light emitting diode connected to said photosensor;

first circuit means connected to said first flip flop circuit through said switch for activating said first flip flop circuit and for activating the alarm in darkness, the alarm moving from the DORMANT state to the STAND-BY state;

second circuit means for activating said first flip flop circuit, said second circuit means putting the alarm in a READY state from the DORMANT state when the alarm is turned on in light, said light emitting diode becoming illustrated, said second circuit means being connected to said first flip flop circuit, said photosensor and said light emitting diode, said alarm entering STAND-BY state with said light emitting diode unit when the alarm is placed in the darkened enclosure, whether activated via said first or second circuit means;

first timing means connected between said first flip flop circuit and said audio signal device for allowing the alarm to initially move from said STAND-BY state to a PRE-ALARM state when the darkened enclosure is opened and said photosensor senses the presence of light, said PRE-ALARM state extending for a first period of time to allow said on/off switch to be depressed, said light emitting diode remaining unlit during said first period of time;

second timing means connected between said first counter circuit and said audio signal device for generating an audio signal for a second time period if said on/off switch is not depressed during said first time period, said alarm moving from the PRE-ALARM state to an ALARM STATE during said time period;

third timing means connected between said first flip flop circuit and said audio signal device for allowing the alarm to move from said ALARM state to said DORMANT state after said second time period has elapsed.

2. The portable alarm in accordance with claim 1, wherein said second timing means is provided with circuitry preventing said light emitting diode from becoming illuminated when said on/off switch is depressed after said first time period has elapsed.

* * * * *